US012339007B2

(12) United States Patent
Mohammed et al.

(10) Patent No.: US 12,339,007 B2
(45) Date of Patent: Jun. 24, 2025

(54) COMBUSTOR NOZZLE, COMBUSTOR AND GAS TURBINE INCLUDING SAME

(71) Applicant: DOOSAN ENERBILITY CO., LTD., Changwon-si (KR)

(72) Inventors: Afzal Pasha Mohammed, Palm Beach Gardens, FL (US); Brian Connolly, San Antonio, TX (US); Prabhat Jha, San Antonio, TX (US); Griffin C. Beck, San Antonio, TX (US); Dong Sik Han, Changwon-si (KR); Ho Keun Kim, Daejeon (KR); Young Jun Shin, Seongnam-si (KR)

(73) Assignee: Doosan Enerbility Co., Ltd., Changwon-si (KR)

( * ) Notice: Subject to any disclaimer, the term of this patent is extended or adjusted under 35 U.S.C. 154(b) by 0 days.

(21) Appl. No.: 18/527,072

(22) Filed: Dec. 1, 2023

(65) Prior Publication Data

US 2025/0180212 A1 Jun. 5, 2025

(51) Int. Cl.
*F23R 3/28* (2006.01)
*F23R 3/12* (2006.01)

(52) U.S. Cl.
CPC ..... *F23R 3/286* (2013.01); *F23R 3/12* (2013.01); *F23D 2900/14021* (2013.01)

(58) Field of Classification Search
CPC ... F23R 3/286; F23R 3/12; F23D 2900/14021
See application file for complete search history.

(56) References Cited

U.S. PATENT DOCUMENTS

| | | | | |
|---|---|---|---|---|
| 9,366,440 | B2 | 6/2016 | Berry | |
| 9,528,702 | B2 | 12/2016 | Boardman et al. | |
| 11,454,396 | B1 * | 9/2022 | Boardman | F23R 3/16 |
| 2006/0156730 | A1 | 7/2006 | Tuck et al. | |
| 2010/0064694 | A1 | 3/2010 | Dodo et al. | |
| 2010/0186413 | A1 | 7/2010 | Lacy et al. | |
| 2010/0192579 | A1 | 8/2010 | Boardman et al. | |

(Continued)

FOREIGN PATENT DOCUMENTS

| | | | |
|---|---|---|---|
| EP | 2145131 | B1 | 1/2010 |
| JP | 2008-281329 | A | 11/2008 |

(Continued)

*Primary Examiner* — Lorne E Meade
*Assistant Examiner* — Alyson Joan Harrington
(74) *Attorney, Agent, or Firm* — Shook, Hardy & Bacon L.L.P.

(57) ABSTRACT

Disclosed herein is a nozzle for a combustor that burns fuel containing hydrogen. The nozzle comprised of a cylindrical tube is configured for introduction of a first fluid (for example, compressed air) and a second fluid (for example, hydrogen or a fuel containing hydrogen). Along an inner surface of the nozzle, one or more fluid vortex generators are disposed. As compressed air flows over the one or more fluid vortex generators, the compressed air swirls inside the nozzle resulting in a turbulent flow of the compressed air. As fuel is then introduced into the nozzle, the fuel encounters the swirling or turbulent flow of compressed air, and the introduced fuel is thoroughly mixed with the compressed air so that the fuel/air mixture will be combusted in a uniform manner. The nozzle may be included in a combustor of a gas turbine engine.

18 Claims, 8 Drawing Sheets

(56) References Cited

U.S. PATENT DOCUMENTS

| | | | | |
|---|---|---|---|---|
| 2011/0073684 | A1 | 3/2011 | Johnson et al. | |
| 2011/0094239 | A1 | 4/2011 | Koizumi et al. | |
| 2012/0198856 | A1 | 8/2012 | Uhm et al. | |
| 2013/0036743 | A1 | 2/2013 | Khan et al. | |
| 2013/0167539 | A1* | 7/2013 | Berry | F23R 3/286 60/737 |
| 2013/0186092 | A1 | 7/2013 | Bathina et al. | |
| 2013/0192234 | A1 | 8/2013 | Stewart et al. | |
| 2014/0216040 | A1 | 8/2014 | Johnson et al. | |
| 2014/0216049 | A1 | 8/2014 | Keener et al. | |
| 2016/0040883 | A1 | 2/2016 | Asai et al. | |
| 2017/0089583 | A1 | 3/2017 | Simmons | |
| 2017/0175636 | A1 | 6/2017 | Hughes et al. | |
| 2017/0268780 | A1 | 9/2017 | Purcell et al. | |
| 2017/0343216 | A1 | 11/2017 | McMahan et al. | |
| 2018/0372318 | A1 | 12/2018 | Bolanos et al. | |
| 2020/0072466 | A1 | 3/2020 | Akiyama et al. | |

FOREIGN PATENT DOCUMENTS

| | | | |
|---|---|---|---|
| JP | 2014013100 | A | 1/2014 |
| JP | 2014055536 | A | 3/2014 |
| JP | 5538113 | B2 | 7/2014 |
| JP | 5614893 | B2 | 10/2014 |
| JP | 2014185831 | A | 10/2014 |
| JP | 5630424 | B2 | 11/2014 |
| JP | 2015-014400 | A | 1/2015 |
| JP | 2016-075548 | A | 5/2016 |
| JP | 5926635 | B2 | 5/2016 |
| JP | 5939942 | B2 | 6/2016 |
| JP | 6022389 | B2 | 11/2016 |
| JP | 6106441 | B2 | 3/2017 |
| JP | 2018-004138 | A | 1/2018 |
| JP | 6262616 | B2 | 1/2018 |
| JP | 6397193 | B2 | 9/2018 |
| WO | 2015037295 | A1 | 3/2015 |
| WO | 2016104725 | A1 | 6/2016 |

* cited by examiner

COMBUSTOR NOZZLE, COMBUSTOR AND GAS TURBINE INCLUDING SAME

TECHNICAL FIELD

Exemplary embodiments relate to a combustor nozzle for operation in association with a combustor and gas turbine engine including the same. The combustor may use at least one of hydrogen fuel and natural gas fuel.

BACKGROUND

A gas turbine engine is a power engine that mixes air compressed by a compressor with fuel for combustion and rotates a turbine with hot gas produced by the combustion. The gas turbine engine is used to drive a generator, an aircraft, a ship, a train, etc.

The gas turbine engine typically includes a compressor, a combustor, and a turbine. The compressor sucks and compresses outside air, and then transmits the compressed air to the combustor. The combustor mixes the compressed air flowing thereinto from the compressor with fuel and burns a mixture thereof to generate high pressure and high temperature combustion gas. The combustion gas produced by the combustion is discharged to the turbine. Turbine blades in the turbine are rotated by the combustion gas, thereby generating power. The generated power is used in various fields, such as generating electric power and actuating machines.

Fuel is injected through nozzles installed in each combustor section of the combustor, and the nozzles allow for injection of gas fuel and/or liquid fuel. In recent years, it is recommended to use hydrogen fuel or fuel containing hydrogen to inhibit or reduce the emission of carbon dioxide given that hydrogen is a carbon-free fuel.

However, while use of hydrogen fuel or fuel containing hydrogen enables the desired effect of inhibiting reducing emission of carbon dioxide, problems can occur owing to the high combustion rate of hydrogen. That is, when hydrogen is introduced as a fuel, if the hydrogen is not thoroughly mixed with the compressed air generated by the compressor, the hydrogen can ignite prematurely or separately from the compressed air causing flashback in the nozzles or fuel/air mixing tubes. Such flashbacks can damage components of the gas turbine engine, and such flashbacks can lead to inefficient gas turbine engine operation owing to inconsistent energy to the gas turbine engine system. In addition, as proper pressure in the gas turbine engine system is necessary for efficient operation, premature or inefficient combustion of hydrogen fuel not properly mixed with compressed air can result in undesired pressure drops in the gas turbine engine system. Another problem owing to inefficient hydrogen fuel combustion is the production of nitrogen oxides (NOx). When air is heated to high temperatures, nitrogen which naturally occurs in air, combines with oxygen to produce NOx. Combusting hydrogen fuels mixed with compressed air when the hydrogen fuel is not properly mixed with the compressed air prior to combustion can result in over heating the compressed air which, in turn, can result in production of undesired levels of NOx.

There is a need in the art for a gas turbine engine fuel nozzle or fuel/air mixing tube in which fuels are mixed with compressed air in a manner that allows for efficient combustion of the fuels for improved gas turbine engine operation and that inhibits production of undesired byproducts.

SUMMARY

Aspects of one or more exemplary embodiments provide a combustor nozzle that enables uniform mixing of fuel and air, a combustor, and a gas turbine engine including the same.

Additional aspects will be set forth in part in the description which follows and, in part, will become apparent from the description, or may be learned by practice of the exemplary embodiments.

According to an aspect of an exemplary embodiment, there is provided a nozzle or fuel/air mixing tube for a combustor that improves the mixing of fuels with compressed air and that enables improved combustion of fuel/air mixtures. According to one aspect of the exemplary embodiment, the nozzle comprised of a cylindrical tube is configured with an inlet formed at a longitudinal end for introduction of a first fluid (for example, compressed air) and a plurality of supply ports or passages formed on a circumferential surface of the nozzle for introduction of a second fluid (for example, hydrogen or a fuel containing hydrogen). Along an inner surface of the nozzle between the inlet and the fuel supply ports or passages, one or more fluid vortex generators in the form of wedge-shaped or three dimensional triangular shaped members are disposed. According to an aspect, as compressed air flows through the inlet, the compressed air encounters the one or more fluid vortex generators which causes the compressed air to swirl inside the nozzle resulting in an increase of turbulence in the flow of the compressed air. As fuel is then introduced into the nozzle, the fuel encounters the swirling or turbulent flow of compressed air. The swirling or turbulent air acts on the introduced fuel and causes the introduced fuel to be thoroughly mixed with the compressed air so that the fuel/air mixture will be combusted in a uniform manner reducing incidence of the above-mentioned problems associated with ill-mixed fuel/air components.

According to an aspect of another exemplary embodiment, the nozzle or fuel/air mixing tube may be configured with a plurality of other nozzles or cylindrical fuel/air mixing tubes as a multi-tube nozzle configuration. According to this aspect, each of the nozzles or fuel/air mixing tubes may include one or more fluid vortex generators inside inlets in longitudinal ends of the nozzles between the inlets and one or more fuel supply ports or passages such that compressed air passing through the inlets and encountering the one or more fluid vortex generators is swirled to produce turbulent air flow. The turbulent air flow acts to mix the compressed air with the fuel introduced through the supply ports or passages downrange from the fluid vortex generators such that the fuel and compressed air are thoroughly mixed for proper subsequent combustion.

According to an aspect of another exemplary embodiment, there is provided a combustor including a burner having a plurality of nozzles for injecting fuel and air, and a combustion chamber for burning a mixture of the fuel and the air therein from which combustion gas may be transmitted to a turbine. According to this aspect each of the nozzles or fuel/air mixing tubes may include one or more fluid vortex generators inside inlets in longitudinal ends of the nozzles between the inlets and one or more fuel supply ports or passages such that compressed air passing through the inlets and encountering the one or more fluid vortex generators is swirled to produce turbulent air flow. The turbulent air flow acts to mix the compressed air with the fuel introduced through the supply ports or passages downrange from the fluid vortex generators such that the fuel and compressed air are thoroughly and uniformly mixed for proper subsequent combustion. According still to this aspect, a plurality of such configured nozzles may be combined to form a multi-tube nozzle configuration for efficient mixing of fuel and compressed air for combustion in a combustion chamber of the combustor.

According to an aspect of a further exemplary embodiment, there is provided a gas turbine engine including a compressor configured to compress air introduced thereinto from the outside, a combustor configured to mix fuel with the air compressed by the compressor for combustion, and a turbine having a plurality of turbine blades rotated by combustion gas produced by the combustion in the combustor. The combustor includes a burner having a plurality of nozzles for injecting the fuel and the air, and a combustion chamber for burning a mixture of the fuel and the air therein from which combustion gas may be transmitted to the turbine. According to this aspect, each of the nozzles or fuel/air mixing tubes may include one or more fluid vortex generators inside inlets in longitudinal ends of the nozzles between the inlets and one or more fuel supply ports or passages such that compressed air passing through the inlets and encountering the one or more fluid vortex generators is swirled to produce turbulent air flow. The turbulent air flow acts to mix the compressed air with the fuel introduced through the supply ports or passages downrange from the fluid vortex generators such that the fuel and compressed air are thoroughly and uniformly mixed for proper subsequent combustion. According still to this aspect, a plurality of such configured nozzles may be combined to form a multi-tube nozzle configuration for efficient mixing of fuel and compressed air for combustion in a combustion chamber of the combustor of the gas turbine engine.

It is to be understood that both the foregoing general description and the following detailed description of exemplary embodiments are exemplary and explanatory and are intended to provide further explanation of the disclosure as claimed.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
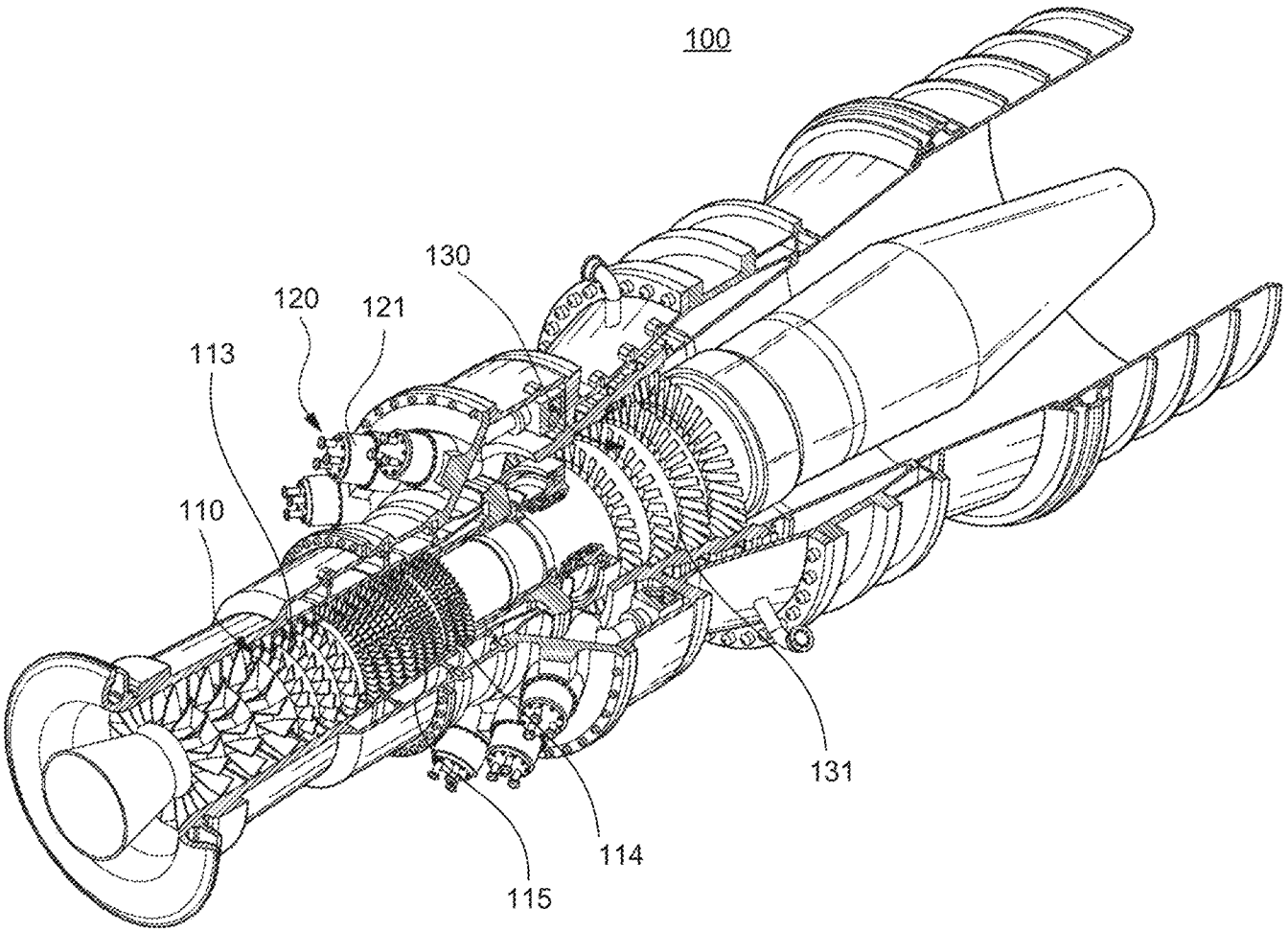
FIG. 1 is a perspective view illustrating an interior of a gas turbine engine according to an embodiment.

Various modifications and different embodiments will be described below in detail with reference to the accompanying drawings so that those skilled in the art can carry out the disclosure. It should be understood, however, that the present disclosure is not intended to be limited to the specific embodiments, but the present disclosure includes modifications, equivalents or replacements that fall within the spirit and scope of the disclosure as defined in the following claims.

The terminology used herein is for the purpose of describing specific embodiments only and is not intended to limit the scope of the disclosure. As used herein, the singular forms "a", "an" and "the" are intended to include the plural forms as well, unless the context clearly indicates otherwise. In the disclosure, terms such as "comprises", "includes", or "have/has" should be construed as designating that there are such features, integers, steps, operations, components, parts, and/or combinations thereof, not to exclude the presence or possibility of adding of one or more of other features, integers, steps, operations, components, parts, and/or combinations thereof.

Exemplary embodiments will be described below in detail with reference to the accompanying drawings. It should be noted that like reference numerals refer to like parts throughout various drawings and exemplary embodiments. In certain embodiments, a detailed description of functions and configurations well known in the art may be omitted to avoid obscuring appreciation of the disclosure by those skilled in the art. For the same reason, some components may be exaggerated, omitted, or schematically illustrated in the accompanying drawings.

Figure 2:
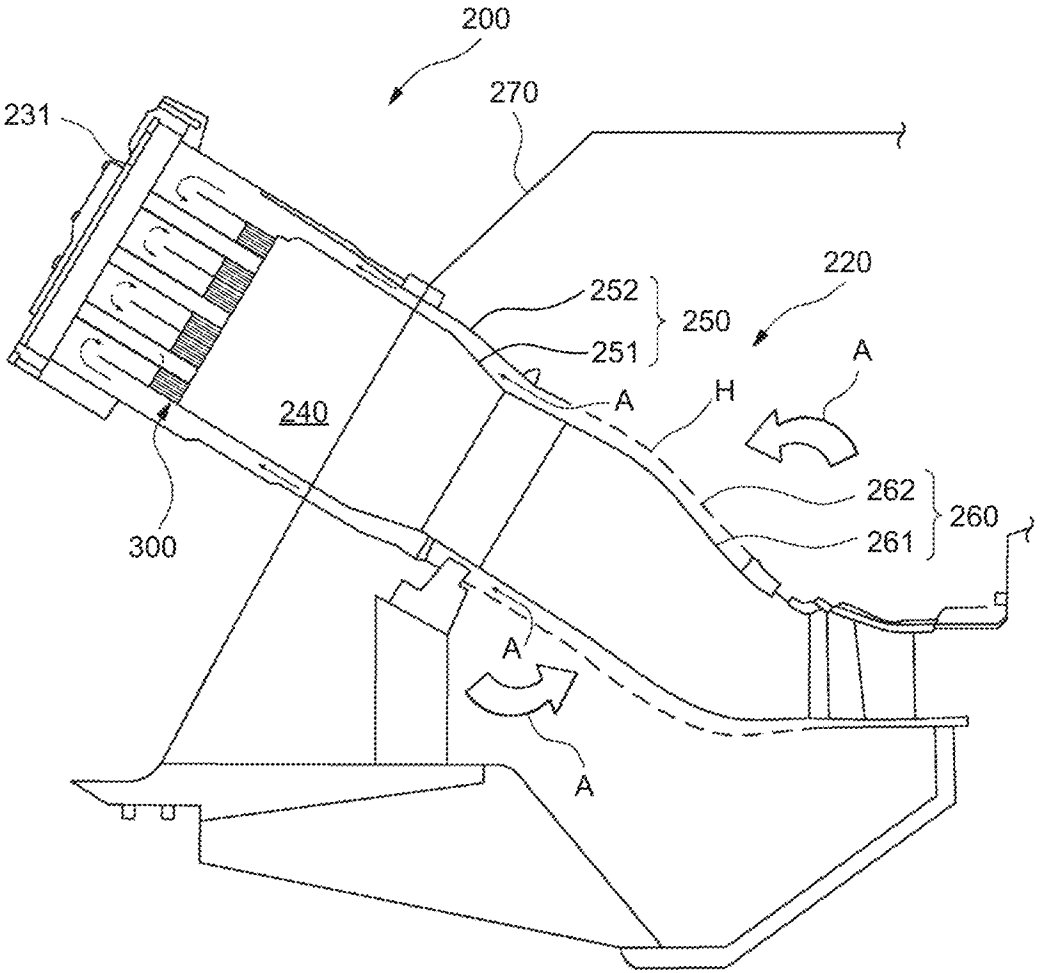
FIG. 2 is a cross-sectional view illustrating a combustor of the gas turbine engine of FIG. 1 according to an embodiment.

Hereinafter, a gas turbine engine according to an exemplary embodiment will be described. FIG. 1 is a perspective view illustrating the interior of the gas turbine engine according to an exemplary embodiment. FIG. 2 is a cross-sectional view illustrating a combustor of the gas turbine engine of FIG. 1 according to an embodiment. Referring to FIGS. 1 and 2, the thermodynamic cycle of the gas turbine engine, which is designated by reference numeral 100, according to the illustrated embodiment may follow a Brayton cycle. The Brayton cycle may consist of four phases including isentropic compression (adiabatic compression), isobaric heat addition, isentropic expansion (adiabatic expansion), and isobaric heat dissipation. In the Brayton cycle, thermal energy may be released by combustion of fuel in an isobaric environment after atmospheric air is sucked and compressed to a high pressure, hot combustion gas may be expanded to be converted into kinetic energy, and exhaust gas with residual energy may then be discharged to the atmosphere. That is, the Brayton cycle may consist of four processes, i.e., compression, heating, expansion, and exhaust.

The gas turbine engine 100 using the above Brayton cycle may include a compressor 110, a combustor 120, and a turbine 130, as illustrated in FIG. 1. Although the following description is given with reference to FIG. 1, the present disclosure may be widely applied to a turbine engine having the same configuration as the gas turbine engine 100 exemplarily illustrated in FIG. 1.

Referring still to FIG. 1, the compressor 110 of the gas turbine engine 100 may suck air from the outside and compress the air. The compressor 110 may supply the combustor 120 with the air compressed by compressor blades 113, and may supply cooling air to a hot region required for cooling in the gas turbine engine 100. In this case, since the air sucked into the compressor 110 is subject to an adiabatic compression process therein, the pressure and temperature of the air that has passed through the compressor 110 increase.

The compressor 110 may be designed as a centrifugal compressor or an axial compressor. In general, the centrifugal compressor is applied to a small gas turbine engine, whereas the multistage axial compressor is applied to the large gas turbine engine 100 as illustrated in FIG. 1 because it is necessary to compress a large amount of air. In the multistage axial compressor, the compressor blades 113 of the compressor 110 rotate along with the rotation of rotor disks to compress air introduced thereinto while delivering the compressed air to rear-stage compressor vanes 114. The air is compressed increasingly to a high pressure while passing through the compressor blades 113 formed in a multistage manner.

A plurality of compressor vanes 113, 114 may be formed in a multistage manner and mounted in a compressor casing 115. The compressor vanes 114 guide the compressed air, which flows from front-stage compressor blades 113, to rear-stage compressor blades 114. In an exemplary embodiment, at least some of the plurality of compressor vanes 114 may be mounted so as to be rotatable within a fixed range for regulating the inflow rate of air or the like.

The compressor 110 may be driven by some of the power output from the turbine 130. To this end, the rotary shaft of the compressor 110 may be directly connected to the rotary shaft of the turbine 130, as illustrated in FIG. 1. In a large gas turbine engine 100, the compressor 110 may require almost half of the power generated by the turbine 100 for driving.

The turbine 130 includes a plurality of rotor disks 131, a plurality of turbine blades radially arranged on each of the rotor disks 131, and a plurality of turbine vanes (not shown). Each of the rotor disks 131 has a substantially disk shape and has a plurality of grooves formed on the outer peripheral portion thereof. The grooves are each formed to have a curved surface so that the turbine blades are inserted into the grooves, and the turbine vanes are mounted in a turbine casing. The turbine vanes are fixed so as not to rotate and serve to guide the direction of flow of the combustion gas that has passed through the turbine blades. The turbine blades generate rotational force while rotating by the combustion gas.

Meanwhile, the combustor 120 may mix the compressed air, which is supplied from the outlet of the compressor 110, with fuel for isobaric combustion to produce combustion gas with high energy. That is, the combustor 120 mixes the compressed air, which is supplied from the outlet of the compressor 110, with fuel for isobaric combustion to produce combustion gas with high energy. The combustor 120 is disposed downstream of the compressor 110 and includes a plurality of burners 200 arranged annularly around a central axis of the gas turbine engine 100.

Referring now to FIG. 2, each of the burners 200 may include a duct assembly 220 having a combustion chamber 240 in which fuel fluid is burned, and a nozzle 300 for injecting the fuel fluid into the combustion chamber 240. The fuel fluid may be supplied from a fuel tank in which fuel (e.g., hydrogen) is stored.

The gas turbine engine may use gas fuel containing hydrogen and/or natural gas, liquid fuel, or composite fuel as a combination thereof, which is the fuel fluid in the present exemplary embodiment. For the gas turbine engine, it is important to make a combustion environment for reducing an amount of emission such as carbon monoxide or nitrogen oxide that is subject to legal regulations. Accordingly, premixed combustion has been increasingly used in recent years in that it enables uniform combustion to reduce emission by lowering a combustion temperature even though it is relatively difficult to control the premixed combustion.

In the case of premixed combustion, after the compressed air introduced from the compressor 110 is mixed with fuel in the nozzle 300, the mixture thereof enters the combustion chamber 240. When combustion is stable after premixed gas is initially ignited by an igniter, the combustion is maintained by the supply of fuel and air.

The duct assembly 220 includes the combustion chamber 240, which is a space for combustion, and further includes a liner 250 and a transition piece 260.

The liner 250 may be disposed downstream of the nozzle 300 and may have a double structure of an inner liner 251 and an outer liner 252. That is, the liner 250 may have a double structure in which the inner liner 251 is surrounded by the outer liner 252. In this case, the inner liner 251 may be a hollow tubular member, and the inside of the inner liner 251 defines the combustion chamber 240. The inner liner 251 may be cooled by the compressed air penetrating into an annular space inside the outer liner 252 through a compressed air inlet hole H.

The transition piece 260 may be positioned downstream of the liner 250, which allows combustion gas produced in the combustion chamber 240 to be released at high speed to the turbine. The transition piece 260 may have a double structure of an inner transition piece 261 and an outer transition piece 262. That is, the transition piece 260 may have a double structure in which the inner transition piece 261 is surrounded by the outer transition piece 262. Like the inner liner 251, the inner transition piece 261 may also be a hollow tubular member. The inner transition piece 261 may have a diameter that gradually decreases from the liner 250 toward the turbine 130. In this case, the inner liner 251 and the inner transition piece 261 may be coupled to each other by a plate spring seal (not shown). The respective ends of the inner liner 251 and the inner transition piece 261 are fixed to the combustor 120 and the turbine, and the plate spring seal has a structure that accommodates an extension in length and diameter due to thermal expansion. As a result, the inner liner 251 and the inner transition piece 261 may be supported.

The outer liner 252 and the outer transition piece 262 may surround the inner liner 251 and the inner transition piece 261, respectively. Compressed air may penetrate into an annular space between the inner liner 251 and the outer liner 252 and an annular space between the inner transition piece 261 and the outer transition piece 262 through the compressed air inlet hole H (the illustrated aspect includes a plurality of holes H). The inner liner 251 and the inner transition piece 261 may be cooled by the compressed air penetrating into the annular spaces.

Meanwhile, the high-temperature and high-pressure combustion gas produced in the combustor 200 is supplied to the turbine 130 through the liner 250 and the transition piece 260. In the turbine 130, the combustion gas applies impingement or reaction force to the turbine blades radially disposed on the rotary shaft of the turbine 130 while expanding adiabatically, so that the thermal energy of the combustion gas is converted into mechanical energy for rotating the rotary shaft. Some of the mechanical energy obtained from the turbine 130 is supplied as energy required to compress air in the compressor, and the rest is utilized as effective energy, such as for driving the power generator to generate electric power.

Referring back to FIG. 2, the compressed air A flowing into the burner 200 is accommodated by a combustor casing 270 and an end cover 231 coupled to each other. The compressed air A may flow into the annular space inside the liner 250 or the transition piece 260 through the compressed air inlet hole H, and then be introduced into the nozzle 300 through switching of the direction of flow thereof by the end cover 231.

Figure 3:
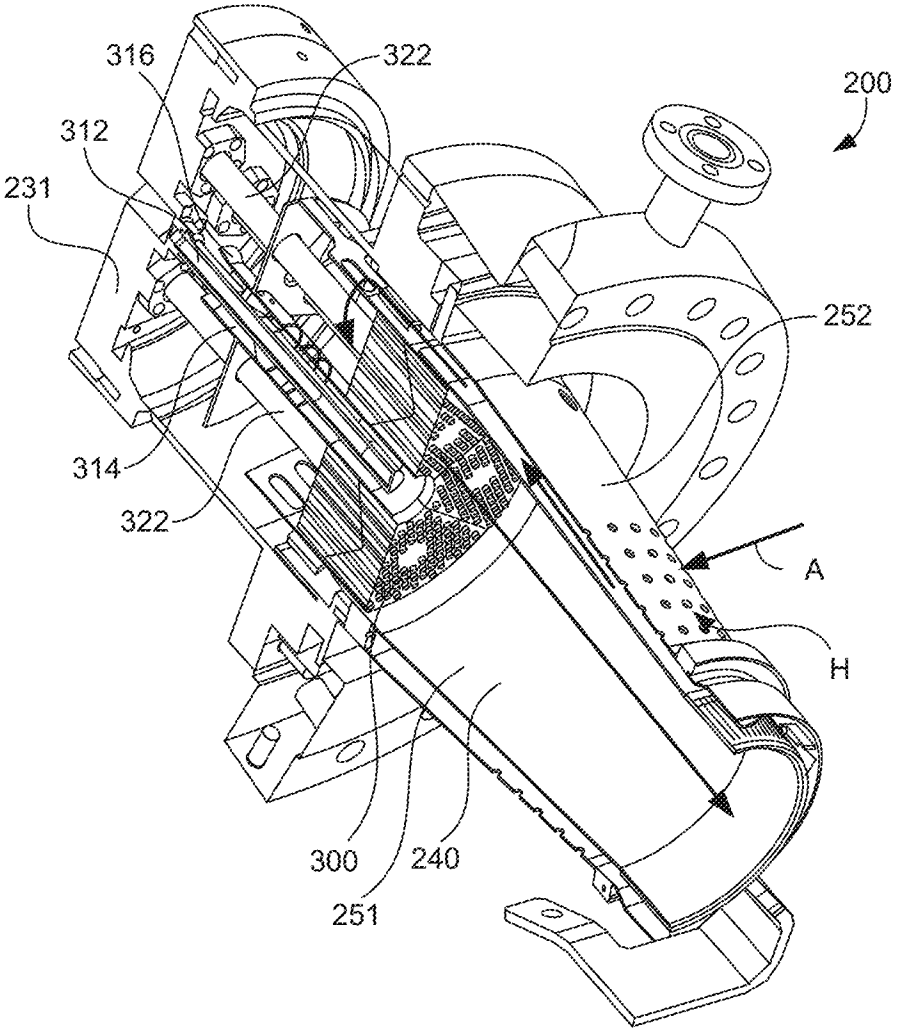
FIG. 3 is a perspective cross-sectional view of components of a gas turbine engine combustor according to an embodiment.

Turning to FIG. 3, a cross-section of a combustor burner 200 is depicted. The burner 200 includes an inner liner 251 that defines a combustion chamber 240 downstream of a nozzle 300. The burner 200 also includes an outer liner 252 that defines an annulus exterior to the inner liner 251 through which compressed air A from the compressor 110 is communicated. The outer liner 252 may include one or more holes H through which compressed air A enters the burner 200. The compressed air A travels towards the end cover 231 until it wraps around the nozzle 300. The compressed air A then passes through the nozzle 300 and is mixed with fuel before being discharged from the nozzle 300 and into the combustion chamber 240.

Figure 4:
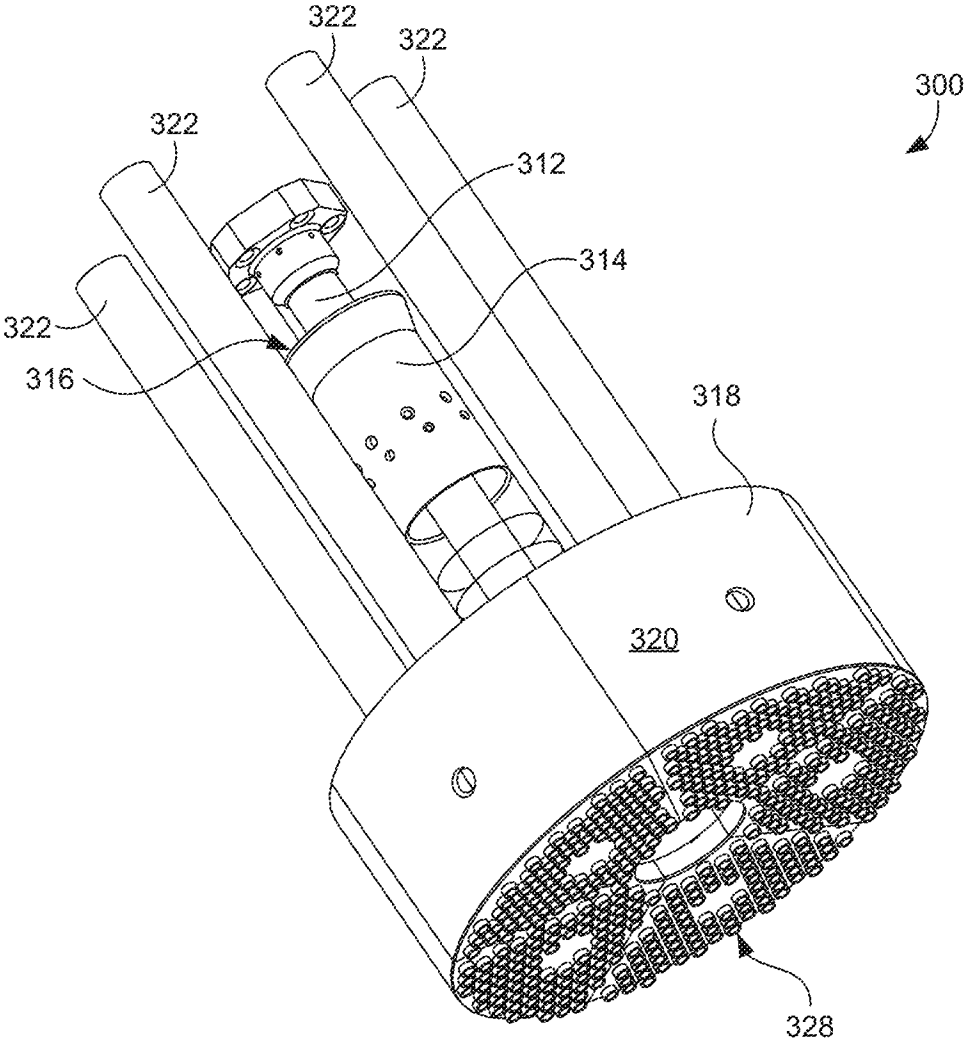
FIG. 4 is a perspective view illustrating a combustor nozzle having a plurality of nozzles disposed therein according to an embodiment.

Referring to FIG. 4, the nozzle 300 may include a central nozzle 310 (e.g., a swirl nozzle) used for start-up or low power operation of the gas turbine engine 100 (e.g., ignition phase, warming phase, up to full-speed no-load phase). The central nozzle 310 may include a central fuel supply line 312 that is in communication with a fuel source and extends through the end cover 231. The central nozzle 310 may also include a central mixing shroud 314 having an air inlet 316 into which compressed air flows. The compressed air mixes with the fuel in the central nozzle 310 and is discharged into the combustion chamber 240 for the above referenced combustion process.

The nozzle 300 may also include one or more outer nozzles 318 arranged radially around the central nozzle 310. For example, the illustrated nozzle 300 includes five outer nozzles 318 that may be independently operated based upon a desired power output from the gas turbine engine 100 (e.g., operating two of the outer nozzles 318 may produce 40% load output). Each of the outer nozzles 318 may include a housing 320 that is coupled to one or more of an adjacent housing or the central nozzle 310. Each of the outer nozzles 318 may also include a fuel supply tube 322. The fuel supply tube 322 may extend upstream from the housing 320 to the end cover 231 to receive fuel from a fuel source. Contained within the housing 320 is a plurality of mixing tubes 324. Each of the mixing tubes 324 includes a first opening 326 (best seen in FIG. 5) on an upstream end 327 of the housing 320 through which compressed air enters. The compressed air is mixed with fuel in the mixing tube 324 and is discharged through a second opening 328 on a downstream end 329 of the housing 320 into the combustion chamber 240 for the above referenced combustion process.

Figure 5:
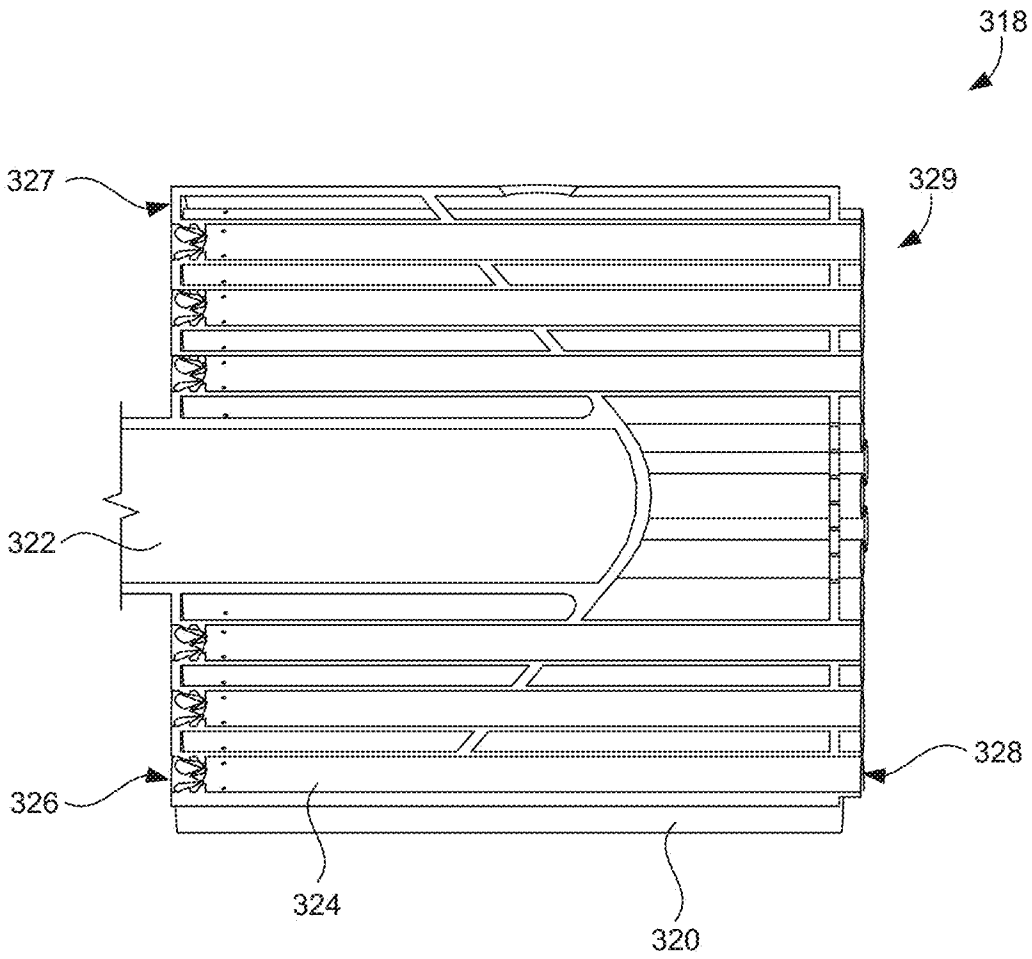
FIG. 5 is a longitudinal cross-sectional view of an outer nozzle according to an embodiment.
Figure 6:
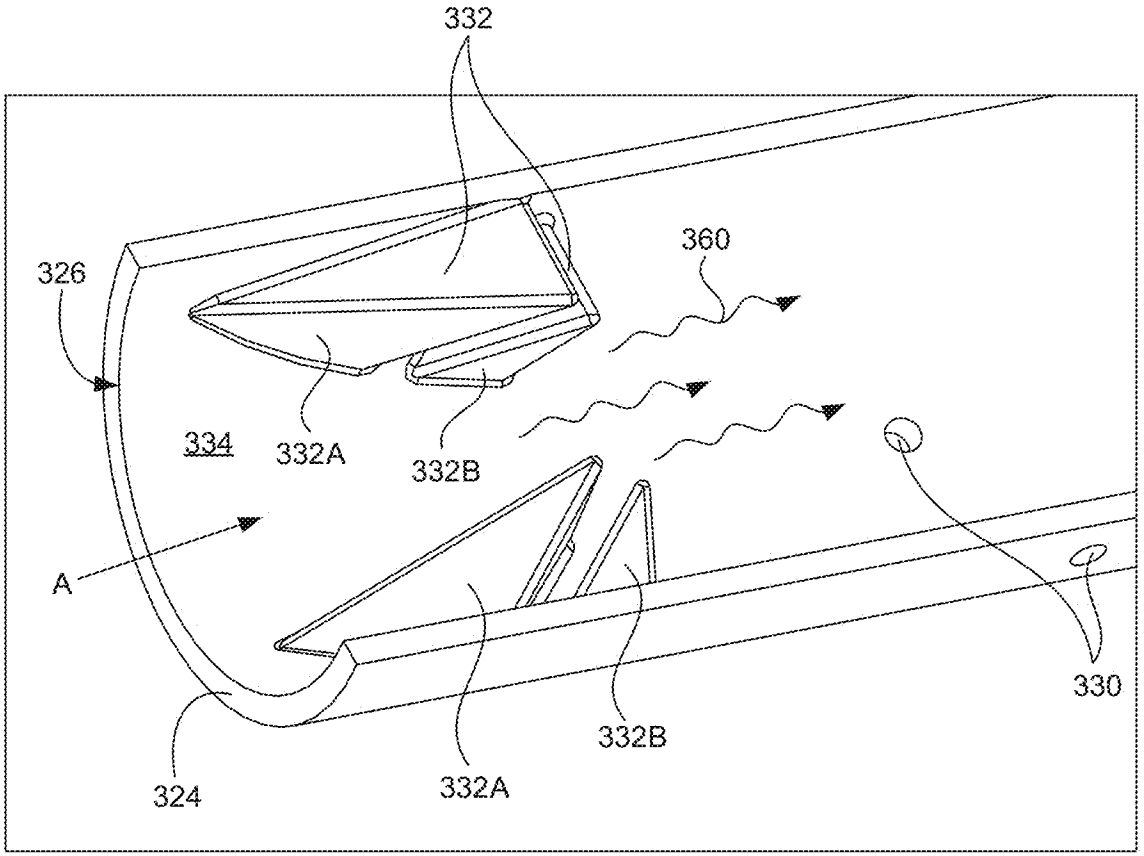
FIG. 6 is a perspective cross-sectional view of a mixing tube according to an embodiment.

Referring to FIG. 5, the mixing tubes 324 are depicted as integral to the housing 320 to form a unitary structure. In other aspects, the mixing tubes 324 may be coupled to the housing 320 as discrete components. FIG. 6 depicts a cross-section of an upstream end of a mixing tube 324. The mixing tube 324 may include the first opening 326, one or more intermediate openings 330 positioned intermediate to the first opening 326 and the second opening 328, and one or more vortex generators 332 positioned intermediate to the first opening 326 and the intermediate openings 330. The intermediate openings 330 may communicate fuel from the fuel supply tube 322 to the mixing tube 324. Each of the vortex generators 332 may extend radially inwardly from an inner surface 334 of the mixing tube 324. Thus, a first fluid (e.g., compressed air) entering the mixing tube 324 through the first opening 326 passes the vortex generators 332 prior to mixing with a second fluid (e.g., fuel) supplied through the intermediate openings 330.

The one or more fluid vortex generators 332 may comprise wedge-shaped members. As illustrated in FIG. 6, the one or more fluid vortex generators may be disposed in a spaced-apart configuration along an inner circumferential surface of the mixing tube 324. According to an aspect, as compressed air flows through the first opening 326, the compressed air encounters the one or more fluid vortex generators 332 which causes the compressed air to swirl 360 inside the mixing tube 324 resulting in an increased turbulent flow of the compressed air inside the mixing tube324. For example, the Reynolds number of the compressed air flow is lower before encountering the vortex generators 332 than after encountering the vortex generators 332 (i.e., the vortex generators increase the Reynolds number of the compressed air flow inside of the mixing tube 324).

Fuel is then introduced into the mixing tube 324 through the intermediate openings 330, the fuel encounters the swirling or turbulent flow of compressed air 360. The swirling or turbulent air 360 acts on the introduced fuel and causes the introduced fuel to be thoroughly mixed with the compressed air so that the fuel/air mixture will be combusted in a more uniform manner.

Figure 7:
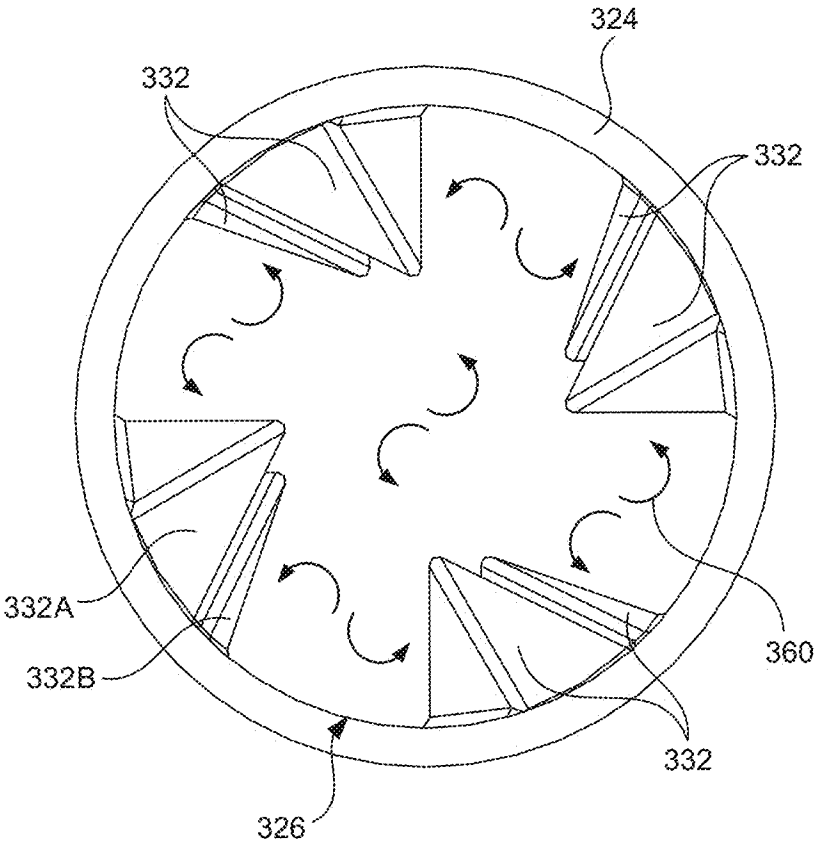
FIG. 7 is a transverse cross-sectional view illustrating the inlet passage and fluid vortex generators of the mixing tube of FIG. 6 according to an embodiment.

FIG. 7 is a transverse cross-sectional view illustrating the mixing tube 324, the first opening 326, and fluid vortex generators 332 of the outer nozzle 318. As illustrated in FIG. 7, the fluid vortex generators 332 may be positioned along the inner surface of the mixing tube 324 in an orientation and configuration for causing compressed air entering the first opening 326 to swirl and become a more turbulent flow 360 that will act on entering fuel (e.g., hydrogen or other suitable fuels) to cause the entering fuel to thoroughly mix with the compressed air.

As should be appreciated and as will be discussed below the fluid vortex generators illustrated herein (FIGS. 5-7) are for purposes of illustration and example only and are not limiting of the numbers, orientations and positioning of fluid vortex generators 332 according to embodiments of the disclosure. That is, the numbers, orientations and positioning of fluid vortex generators 332 may be modified as needed to provide desired swirling of entering compressed air necessary for desired fuel/air mixing. For example, the sizes and interior dimensions of the mixing tubes 324 may vary greatly from one gas turbine engine 100 to another, and thus, the numbers, orientations and positioning of fluid vortex generators 332 may similarly vary as required for a given gas turbine engine configuration.

Figure 8:
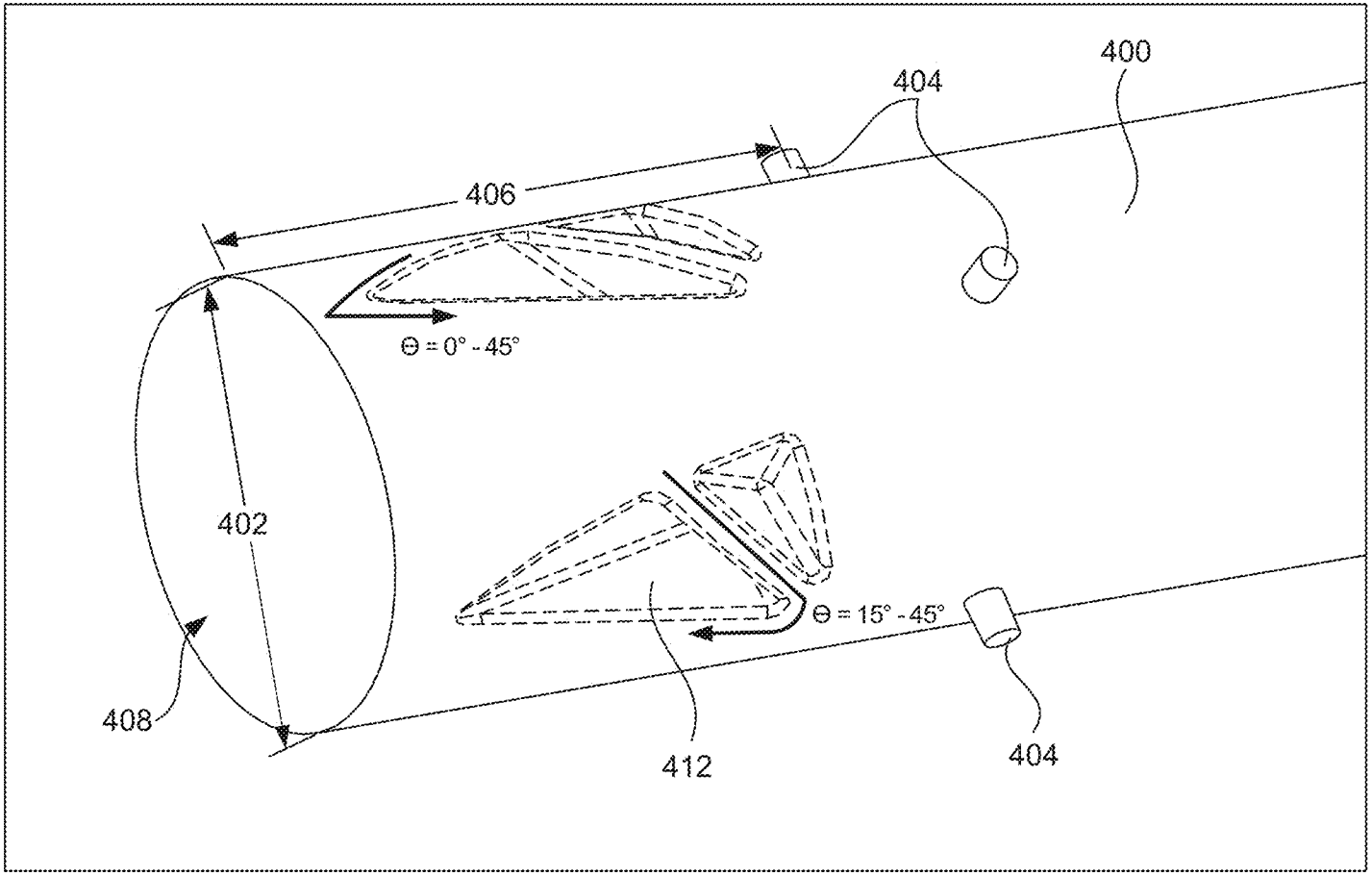
FIG. 8 is a perspective exterior view of a core around which the mixing tube of FIG. 6 may be cast according to an embodiment.

Referring then to FIG. 8, a perspective view is illustrated of a core 400 around which the mixing tube 324 may be cast. As described above, the numbers, orientations and positioning of the fluid vortex generators may vary depending on the size and performance requirements for a given gas turbine engine 100, combustor 120, nozzle 300, etc. for optimizing fuel/air mixing. As illustrated in FIG. 8, the core 400 has a diameter 402 (which corresponds to an inner diameter of the mixing tube 324) at the longitudinal end 408 of the core 400. Spaced away from the longitudinal end 408 of, and extending from, the core 400 are fuel supply extensions 404 (which correspond to the positions and shape of the intermediate openings 330 formed radially around the mixing tube 324). The fuel supply extensions 404 are located at a distance 406 from the longitudinal end 408 of the core 400. The fuel supply extensions are arranged around the outer circumference of the core 400 in a clocking fashion. For example, the configuration illustrated in FIG. 8 shows the fuel supply ports clocked 90 degrees apart about the circumference of the core 400.

Referring still to FIG. 8, the core 400 includes an outer surface 410 around which the inner surface 334 of the mixing tube 324 is formed. Recessed into the outer surface 410 are a plurality of vortex notches 412 (which correspond to the fluid vortex generators 332 that extend inward from the inner surface 334 of the mixing tube 324). In the illustrated aspect, the vortex notches 412 have a triangular-pyramidal shape.

In recent years, it is recommended to use hydrogen fuel or fuel containing hydrogen to inhibit or reduce the emission of carbon dioxide given that hydrogen is a carbon-free fuel. However, while use of hydrogen fuel or fuel containing hydrogen enables the desired effect of inhibiting reducing emission of carbon dioxide, problems can occur owing to the high combustion rate of hydrogen. That is, when hydrogen is introduced as a fuel, if the hydrogen is not thoroughly mixed with the compressed air generated by the compressor, the hydrogen can ignite prematurely or separately from the compressed air causing flashback in the nozzles or fuel/air mixing tubes. Such flashbacks can damage components of the gas turbine engine, and such flashbacks can lead to inefficient gas turbine engine operation owing to inconsistent energy to the gas turbine engine system. Another problem owing to inefficient hydrogen fuel combustion is the production of nitrogen oxides (NOx). When air is heated to high temperatures, nitrogen which naturally occurs in air, combines with oxygen to produce NOx. Combusting hydrogen fuels mixed with compressed air when the hydrogen fuel is not properly mixed with the compressed air prior to combustion can result in over heating the compressed air which, in turn, can result in production of undesired levels of NOx.

As will be discussed below, by controlling the size, shape, and orientation of the fluid vortex generators 332, the relative spacing of the fuel input from the air input in the mixing tube 324, hydrogen fuel (e.g., hydrogen, hydrogen blends, fuels containing hydrogen) can be mixed with compressed air in a manner that allows for efficient combustion of the fuels for improved gas turbine operation and that inhibits production of undesired byproducts (e.g., $CO_2$, NOx, etc.).

In the illustrated aspect shown in FIGS. 5-7, the fluid vortex generators 332 are illustrated as pairs 332A and 332B. As should be understood, the illustrated pairs 332A, 332B is an example configuration and is not limiting of a configuration in which the fluid vortex generators 332 are not paired. As shown in FIG. 6, each pair of fluid vortex generators may include a first vortex generator 332A positioned at a first distance from the first opening 326 formed at the longitudinal end of the mixing tube 324 and a second vortex generator 332B positioned at a second distance from the first opening 326 formed at the longitudinal end of the mixing tube 324, the second distance being greater than the first distance. In addition, the fluid vortex generators 332 are illustrated as wedge-shaped or three dimensional triangular shaped for causing a fluid (e.g., air) to swirl and/or increase in turbulence after the fluid passes over the fluid vortex generators 332 to allow the swirled or turbulent air to serve as a mixer of the air with fuel introduced through the intermediate openings 330. Each of the fluid vortex generators 332 is configured with a height from the inner surface 334 of the mixing tube 324 to a highest point of the corresponding fluid vortex generator 332. Each of the fluid vortex generators 332 is positioned with a wedge angle for optimizing a swirling effect as air passes over the fluid vortex generators 332. In addition, each fluid vortex generators 332 is configured with an angle of attack relative to the direction of air flow through the mixing tube 324 as compressed air enters the mixing tube 324 to optimize a swirling effect as air passes over the corresponding fluid vortex generator 332.

Each of these parameters for the fluid vortex generators 332 affects the swirling effect applied to compressed air as it passes over the fluid vortex generators 332 through the mixing tube 324. Thus, each of these parameters may be modified to produce desired impact on the flow of compressed air passing through the mixing tube 324 for optimizing mixture of compressed air with fuel (e.g., hydrogen).

According to one embodiment, the distance (e.g., distance 406) of the intermediate openings 330 from the first opening 326 of the mixing tube 324 may be set at a minimum of one times (1D) the diameter (e.g., diameter 402) of the first opening 326 of the mixing tube 324 to a maximum of two times (2D) the diameter (e.g., diameter 402). That is, the distance 406 on the core 400 is proportional to the diameter 402 of the longitudinal end 408 of the core 400.

The height of the fluid vortex generators 332 is also proportional to the diameter of the mixing tube 324. In aspects, the height may be set at a minimum of 0.1 times (0.1D) the diameter (e.g., diameter 402) of the first opening 326 of the mixing tube 324 to a maximum of 0.3 times (0.3D) the diameter (e.g., diameter 402) of the first opening 326 of the mixing tube 324.

The wedge angle may be set at a minimum of fifteen (15) degrees to a maximum of forty-five (45) degrees relative to the direction of air flow. The angle of attack may be set at a minimum of zero (0) degrees to a maximum of forty-five (45) degrees. The clocking configuration of the intermediate openings 330 may be set at a minimum of zero (0) degrees to a maximum of ninety (90) degrees relative to the fluid vortex generators 332 (e.g., the intermediate openings 330 may be circumferentially aligned with the fluid vortex generators 332 in an axial direction, or may be offset therefrom up to ninety (90) degrees).

In addition, the velocity of compressed air through the mixing tube 324 may be set at a minimum of 80 meters per second to a maximum of 120 meters per second, in accordance with some embodiments. As should be appreciated, these configuration parameters for the fluid vortex generators 332, and intermediate openings 330 are example parameters for the mixing tube 324, but these parameters are not limiting of many different parameters that may be set to achieve desired swirling of compressed air by the fluid vortex generators 332 to thoroughly mix entering compressed air with entering fuel.

While one or more exemplary embodiments have been described with reference to the accompanying drawings, it will be apparent to those skilled in the art that various variations and modifications may be made by adding, changing, or removing components without departing from the spirit and scope of the disclosure as defined in the appended claims, and these variations and modifications fall within the spirit and scope of the disclosure as defined in the appended claims.

What is claimed is:

1. A nozzle for a combustor that burns fuel, comprising: a central nozzle, one or more outer nozzles arranged radially around the central nozzle, comprising:

a housing coupled to one or more of an adjacent housing or the central nozzle, a plurality of mixing tubes through which air and fuel can flow;

wherein each mixing tube in the plurality of mixing tubes comprises:

a first opening formed at a longitudinal end thereof for introduction of a first fluid into the mixing tube;

one or more intermediate openings formed on an outer circumferential surface of the mixing tube for introduction of a second fluid into the mixing tube; and a plurality of fluid vortex generators disposed on an inner circumferential surface of the mixing tube between the longitudinal end and the one or more intermediate openings;

wherein the plurality of fluid vortex generators is disposed as a pair of fluid vortex generators, and wherein a first vortex generator of the pair of fluid vortex generators is positioned at a first distance from the first opening formed at the longitudinal end of the mixing tube and a second vortex generator of the pair of fluid vortex generators is positioned at a second distance from the first opening formed at the longitudinal end of the mixing tube, the second distance being greater than the first distance.

2. The nozzle according to claim 1, wherein the first fluid passes over the plurality of fluid vortex generators and mixes with the second fluid.

3. The nozzle according to claim 1, wherein the plurality of fluid vortex generators is disposed as a plurality of the pair of fluid vortex generators.

4. The nozzle according to claim 3, wherein the plurality of the pair of fluid vortex generators are disposed in a spaced-apart configuration along the inner circumferential surface of the mixing tube.

5. The nozzle according to claim 1, wherein the one or more intermediate openings formed on the outer circumferential surface of the mixing tube are positioned apart from the longitudinal end of the mixing tube at a third distance sufficient to allow the plurality of fluid vortex generators to be positioned between the longitudinal end and the one or more intermediate openings such that the plurality of fluid vortex generators engage the first fluid prior to the first fluid mixing with the second fluid.

6. The nozzle according to claim 5, wherein the third distance is proportional to a diameter of the first opening formed at the longitudinal end of the mixing tube.

7. The nozzle according to claim 1, wherein each of the plurality of fluid vortex generators is wedge-shaped.

8. The nozzle according to claim 1, wherein each of the plurality of fluid vortex generators is three-dimensional triangular shaped.

9. The nozzle according to claim 8, wherein the plurality of fluid vortex generators are positioned to allow an angle of attack of each of the plurality of fluid vortex generators to engage the first fluid after the first fluid enters the first opening formed at the longitudinal end of the mixing tube whereby the first fluid forms a turbulent flow after the first fluid engages with the plurality of fluid vortex generators.

10. The nozzle according to claim 9, wherein the plurality of fluid vortex generators are positioned to allow a wedge angle of each of the plurality of fluid vortex generators to engage the first fluid after the first fluid enters the first opening formed at the longitudinal end of the mixing tube whereby the first fluid forms the turbulent flow after the first fluid engages with the plurality of fluid vortex generators.

11. The nozzle according to claim 1, wherein the plurality of mixing tubes form a multi-tube configuration for passing a mixture of the first and second fluids through each mixing tube of the plurality of mixing tubes for combustion in a combustor burner.

12. The nozzle according to claim 1, wherein the first fluid is compressed air and the second fluid is a fuel whereby a passing of the compressed air over the plurality of fluid vortex generators swirls the compressed air into a turbulent flow that causes the compressed air to uniformly mix with the fuel.

13. The nozzle according to claim 12, whereby the fuel is hydrogen.

14. A combustor comprising:

a burner having a central nozzle and a plurality of outer nozzles arranged radially around the central nozzle for injecting fuel and air, and a duct assembly having a combustion chamber coupled to one side of the burner to burn a mixture of the fuel and the air therein and transmit combustion gas to a turbine, wherein each outer nozzle of the plurality of outer nozzles comprises:

a mixing tube through which the air and the fuel can flow;

the mixing tube having a first opening formed at a longitudinal end thereof for introduction of a first fluid into the mixing tube;

the mixing tube having one or more intermediate openings formed on an outer circumferential surface of the mixing tube for introduction of a second fluid into the mixing tube; and a plurality of fluid vortex generators disposed on an inner circumferential surface of the mixing tube between the longitudinal end and the one or more intermediate openings;

wherein the plurality of fluid vortex generators is disposed as a pair of fluid vortex generators, and wherein a first vortex generator of the pair of fluid vortex generators is positioned at a first distance from the first opening formed at the longitudinal end and a second vortex generator of the pair of fluid vortex generators is positioned at a second distance from the first opening formed at the longitudinal end, the second distance being greater than the first distance.

15. The combustor according to claim 14, wherein the first fluid is compressed air and the second fluid is the fuel whereby a passing of the compressed air over the plurality of fluid vortex generators swirls the compressed air into a turbulent flow that causes the compressed air to uniformly mix with the fuel.

16. The combustor according to claim 14, wherein each outer nozzle of the plurality of outer nozzles comprises a plurality of the mixing tube are combined to form a multi-tube configuration for passing a mixture of the first and second fluids through each of the plurality of the mixing tube to the combustion chamber of the burner.

17. A gas turbine engine comprising a compressor configured to compress air introduced thereinto from the outside, a combustor configured to mix fuel with the air compressed by the compressor for combustion, and a turbine having a plurality of turbine blades rotated by combustion gas produced by the combustion in the combustor, wherein the combustor comprises a burner having a central nozzle and a plurality of outer nozzles arranged radially around the central nozzle for injecting the fuel and the air, and a duct assembly coupled to one side of the burner to burn a mixture of the fuel and the air therein and transmit the combustion gas to the turbine, wherein each outer nozzle of the plurality of outer nozzles comprises:

a mixing tube through which the air and the fuel can flow;

the mixing tube having a first opening formed at a longitudinal end thereof for introduction of a first fluid into the mixing tube;

the mixing tube having one or more intermediate openings formed on an outer circumferential surface of the mixing tube for introduction of a second fluid into the mixing tube;

a plurality of fluid vortex generators disposed on an inner circumferential surface of the mixing tube between the longitudinal end and the one or more intermediate openings;

wherein the plurality of fluid vortex generators is disposed as a pair of fluid vortex generators, and wherein a first vortex generator of the pair of fluid vortex generators is positioned at a first distance from the first opening formed at the longitudinal end and a second vortex generator of the pair of fluid vortex generators is positioned at a second distance from the first opening formed at the longitudinal end, the second distance being greater than the first distance; and wherein the duct assembly comprises a double structure liner, the double structure liner comprising an inner liner and an outer liner, and wherein an inside of the inner liner defines a combustion chamber.

18. The gas turbine engine according to claim 17, wherein the one or more intermediate openings formed on the outer circumferential surface of the mixing tube are positioned apart from the longitudinal end of the mixing tube at a distance sufficient to allow the plurality of fluid vortex generators to be positioned between the longitudinal end and the one or more intermediate openings such that the plurality of fluid vortex generators engages the first fluid prior to the first fluid mixing with the second fluid.

* * * * *